US012742325B2

(12) United States Patent
Willits et al.

(10) Patent No.: US 12,742,325 B2
(45) Date of Patent: Sep. 22, 2026

(54) BUILDING ENVELOPE MEMBRANE FOR BUILDING APPLICATIONS AND RELATED SYSTEMS AND RELATED METHOD

(71) Applicant: BMIC LLC, Dallas, TX (US)

(72) Inventors: James Willits, Fort Worth, TX (US); Steven J. Warakomski, Charlottesville, VA (US); Carlos Daniel Stagnaro, Charlottesville, VA (US); Benjamin Meyer, Dallas, TX (US); Luke Geoffrion, Malvern, AR (US); Christopher Fetterman, Beaufort, SC (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 19/226,930

(22) Filed: Jun. 3, 2025

(65) Prior Publication Data

US 2025/0369228 A1 Dec. 4, 2025

Related U.S. Application Data

(60) Provisional application No. 63/655,205, filed on Jun. 3, 2024.

(51) Int. Cl.
*E04D 5/14* (2006.01)
*E04D 1/34* (2006.01)
(Continued)

(52) U.S. Cl.
CPC ..... *E04D 5/148* (2013.01); *E04D 1/34* (2013.01); *E04D 5/06* (2013.01); *E04D 5/10* (2013.01);
(Continued)

(58) Field of Classification Search
CPC .. E04D 5/148; E04D 5/06; E04D 5/10; E04D 2001/3435
See application file for complete search history.

(56) References Cited

U.S. PATENT DOCUMENTS 3,358,355 A 12/1967 Youssi et al.
3,937,640 A 2/1976 Tajima et al.
(Continued)

FOREIGN PATENT DOCUMENTS

GB 2 381 805 A 5/2003
JP 2001030453 A 2/2001
(Continued)

OTHER PUBLICATIONS

"Carlisle Sure-Flex PVC with APEEL Protective Film," PVC-12185, 2021.
(Continued)

*Primary Examiner* — Brian E Glessner
(74) *Attorney, Agent, or Firm* — GREENBERG TRAURIG, LLP

(57) ABSTRACT

A building system and corresponding method may include a building structure. A building system and corresponding method may include a building envelope membrane installed on the building structure, the building envelope membrane comprising: a first release liner, wherein the first release liner comprises: a first polymer, and a UV stabilizer, wherein the first release liner includes 1 wt. % to 90 wt. % of the UV stabilizer based on a total weight of the first release liner, wherein the first release liner is an outer layer, wherein the first release liner is removable, a first adhesive layer, a membrane layer, wherein the first adhesive layer is positioned between the first release liner and the membrane layer; and a second adhesive layer, wherein the membrane layer is positioned between the first adhesive layer and the
(Continued)

second adhesive layer, wherein the second adhesive layer contacts the building structure.

20 Claims, 7 Drawing Sheets

(51) Int. Cl.
*E04D 5/06* (2006.01)
*E04D 5/10* (2006.01)
*E04F 13/08* (2006.01)

(52) U.S. Cl.
CPC .. *E04F 13/0887* (2013.01); *E04D 2001/3435* (2013.01)

(56) References Cited

U.S. PATENT DOCUMENTS 4,386,981 A 6/1983 Clapperton
4,576,864 A 3/1986 Krautter et al.
4,584,220 A 4/1986 Melbye
5,916,654 A 6/1999 Phillips et al.
6,237,288 B1 5/2001 Jenkins et al.
6,656,557 B2 * 12/2003 Phillips ..... B32B 11/04 428/351
6,701,685 B2 * 3/2004 Rippey ..... E04D 5/12 428/40.1
6,924,015 B2 8/2005 Zanchetta et al.
7,115,313 B2 10/2006 Zanchetta et al.
7,178,306 B2 2/2007 Fritz
7,291,358 B1 11/2007 Fensel et al.
7,299,599 B2 11/2007 Swann
7,368,155 B2 5/2008 Larson et al.
7,776,177 B2 8/2010 Hubbard
8,726,611 B2 5/2014 Swei et al.
8,833,037 B2 9/2014 French et al.
9,163,410 B2 10/2015 French et al.
9,611,647 B2 4/2017 Yang
9,874,017 B2 1/2018 Jenkins et al.
10,167,637 B2 1/2019 Hubbard
10,233,646 B2 3/2019 McGraw et al.
10,385,572 B2 8/2019 Granovsky
10,414,950 B2 * 9/2019 Hübscher ..... B32B 7/12
10,422,138 B1 9/2019 French et al.
10,465,381 B2 11/2019 Garcia
10,801,207 B2 10/2020 French et al.
11,525,264 B2 12/2022 Tselepis et al.
11,566,396 B2 * 1/2023 Rudyan ..... E02D 31/10
11,834,836 B2 12/2023 Yang
12,221,567 B2 * 2/2025 Wigger ..... C09J 5/00
2003/0015275 A1 1/2003 Phillips et al.
2003/0219563 A1 11/2003 Zanchetta et al.
2004/0009319 A1 1/2004 Zanchetta et al.
2004/0244316 A1 * 12/2004 Macuga ..... C09J 7/22 52/198
2005/0214496 A1 9/2005 Borenstein
2006/0210753 A1 9/2006 Kadlec
2006/0243388 A1 * 11/2006 Kubiak ..... B32B 25/16 156/289
2006/0292945 A1 12/2006 Kuhn et al.
2007/0190342 A1 8/2007 Teng
2008/0124576 A1 5/2008 Elliott
2008/0141604 A1 6/2008 Arthurs et al.
2011/0083765 A1 * 4/2011 Stark ..... F16L 55/1654 428/476.3
2013/0086869 A1 * 4/2013 Couturier ..... E04F 13/0887 52/746.1
2013/0295295 A1 11/2013 Douglas
2014/0259996 A1 9/2014 Jenkins et al.
2016/0002930 A1 1/2016 Sylvester, II
2017/0175385 A1 6/2017 Raidt et al.
2022/0178144 A1 6/2022 Wang et al.

FOREIGN PATENT DOCUMENTS

JP 2009233953 A 10/2009
WO 2011/032727 A1 3/2011

OTHER PUBLICATIONS

"Carlisle Sure-Weld TPO with APEEL Protective Film," 607786—TPO-4949 "Apeel Sell Sheet" 2022.
"GAF SA Vapor Retarder XL: Self-Adhered Vapor Retarder," 2024—COMGN847-PDF-1224.

* cited by examiner

BUILDING ENVELOPE MEMBRANE FOR BUILDING APPLICATIONS AND RELATED SYSTEMS AND RELATED METHOD

CROSS-REFERENCE TO RELATED APPLICATIONS

The present application claims priority to and benefit of U.S. Provisional Patent Application No. 63/655,205, filed Jun. 3, 2024 and entitled "BUILDING ENVELOPE MEMBRANE FOR BUILDING APPLICATIONS AND RELATED SYSTEMS AND RELATED METHOD" the entirety of which is herein incorporated by reference.

FIELD

The disclosure generally relates a building envelope membrane for building applications, as well as an associated building system and method.

BACKGROUND

Building envelope membranes are useful as protective barriers between an outdoor environment and an interior of a building structure. As protective barriers, the building envelope membranes are designed to withstand numerous elements. In one application, the building envelope membrane is installed on a low slope roof. In another embodiment, the building envelope membrane is installed on one or more external walls of a building structure.

SUMMARY

The Claims, rather than the Summary, define covered embodiments of the present invention. The Summary is a high-level overview of various aspects of the invention, and introduces some concepts that are further described in the Detailed Description below. The Summary is not intended to identify key or essential features of the claimed subject matter, and also is not intended to be used in isolation to determine the scope of the claimed subject matter. Instead, the claimed subject matter should be understood by reference to appropriate portions of the Specification and drawings, as well as to each claim.

In some embodiments, a building system includes a building structure; and a building envelope membrane installed on the building structure, the building envelope membrane comprising a first release liner, wherein the first release liner comprises a first polymer, and a UV stabilizer, wherein the first release liner includes 1 wt. % to 90 wt. % of the UV stabilizer based on a total weight of the first release liner, wherein the first release liner is an outer layer, wherein the first release liner is removable; a first adhesive layer; a membrane layer, wherein the first adhesive layer is positioned between the first release liner and the membrane layer; and a second adhesive layer, wherein the membrane layer is positioned between the first adhesive layer and the second adhesive layer, wherein the second adhesive layer contacts the building structure.

In some embodiments, the first release liner includes a sufficient amount of a UV stabilizer, such that, when tested in accordance with a weathering test used to test for exposure for 180 days, the first release liner passes the weathering test. In some embodiments, the first release liner further comprises at least one of an antioxidant, a process stabilizer, a thermal stabilizer, or a UV absorber. In some embodiments, the first polymer comprises polyethylene.

In some embodiments, the membrane layer comprises a vapor retarder membrane layer. In some embodiments, the membrane layer comprises a multi-layer membrane layer. In some embodiments, the membrane layer comprises a first membrane layer, a second membrane layer, and a third membrane layer, wherein the second membrane layer is between the first membrane layer and the third membrane layer, wherein at least one of the first membrane layer or the third membrane layer comprises a polymer layer.

In some embodiments, the second membrane layer comprises at least one of a solid polymer layer or a woven polymer layer. In some embodiments, at least one of the first adhesive layer or the second adhesive layer comprises a butyl adhesive.

In some embodiments, the building structure is a roof deck. In some embodiments, the building structure is an external wall.

In some embodiments, a method of installation includes obtaining a building envelope membrane, the building envelope membrane comprising a first release liner, wherein the first release liner comprises a first polymer, and a UV stabilizer, wherein the first release liner includes 1 wt. % to 90 wt. % of the UV stabilizer based on a total weight of the first release liner, wherein the first release liner is removable; a first adhesive layer; a membrane layer, wherein the first adhesive layer is positioned between the first release liner and the membrane layer; a second adhesive layer, wherein the membrane layer is positioned between the first adhesive layer and the second adhesive layer; and a second release liner, wherein the second release liner is removable to expose the second adhesive layer; removing the second release liner, thereby exposing the second adhesive layer; and adhering the building envelope membrane to a building structure with an exposed portion of the second adhesive layer.

In some embodiments, after the adhering the building envelope membrane to the building structure, removing the first release liner after a specified time, thereby exposing the first adhesive layer; and positioning a building component on an exposed portion of the first adhesive layer, and the exposed portion of the first adhesive layer adheres the building component to the building envelope membrane.

In some embodiments, the building component includes at least one of a photovoltaic (PV) panel, a modified bitumen (MODBIT) substrate, a roofing shingle, an oriented strand board (OSB), a roll good, a board (such as but not limited to at least one of a foam board (e.g., a polyisocyanurate (ISO) foam board), a coverboard, a fiberglass insulation board or any combination thereof), a fire retardant board, a hail resistant board, a high density cover board, a cement board, or any combination thereof.

In some embodiments, the first release liner includes a sufficient amount of a UV stabilizer, such that, when tested in accordance with a weathering test used to test for exposure for 180 days, the first release liner passes the weathering test.

In some embodiments, the first release liner further comprises at least one of an antioxidant, a process stabilizer, a thermal stabilizer, or a UV absorber. In some embodiments, the membrane layer comprises a vapor retarder membrane layer. In some embodiments, the membrane layer comprises a multi-layer membrane layer.

In some embodiments, the building structure is a roof deck. In some embodiments, the building structure is an external wall.

BRIEF DESCRIPTION OF THE FIGURES

This section refers to the drawings that form a part of this disclosure, and which illustrate some of the embodiments of structure, materials, and/or methods of the present invention described herein.

DETAILED DESCRIPTION

Figure 1:
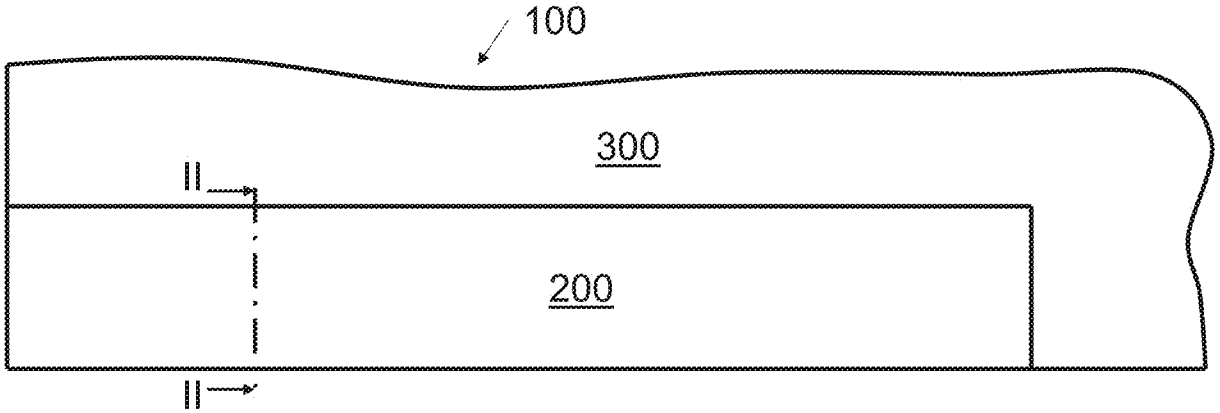
FIG. 1 is a top schematic view of a building system including a building envelope membrane installed on a building structure, in accordance with some embodiments.

In addition to the benefits and improvements that the Specification discloses, other objects and advantages that the Specification provides will become apparent from the following description taken in conjunction with the accompanying figures. Although the description discloses and describes detailed embodiments of the present disclosure, the disclosed embodiments are merely illustrative of the disclosure that may be embodied in various forms. In addition, each of the examples given regarding the various embodiments of the disclosure are intended to be illustrative, and not restrictive.

Throughout the Specification, including the Detailed Description and Claims, the following terms take the meanings explicitly associated herein, unless the context dictates otherwise. The phrases "in an embodiment," "in some embodiments," and any similar phrase, as used herein, do not necessarily refer to the same embodiment or embodiments, though the phrases may refer to the same embodiment or embodiments. Furthermore, the phrases "in another embodiment," and any similar phrase, as used herein, do not necessarily refer to a different embodiment, although the phrases may refer to a different embodiment. All embodiments of the disclosure are intended to be combinable without departing from the scope or spirit of the disclosure.

As used herein, the term "building structure" refers to any structural component of a building. For example, in some embodiments, a building structure comprises at least one of an external wall, a roof substrate, a roof deck, a skylight, a roof edge, a roof penetration, rough openings such as a window frame and/or a door frame, or any combination thereof. In some embodiments, a roof deck is a structure supporting a roof. In some embodiments, a roof substrate comprises at least one of a plywood substrate, a glass substrate, a cellulosic substrate, a roof shingle, a mat, a fabric, a glass mat, a fiberglass mat, an underlayment, a building envelope membrane, a roof deck, a photovoltaic (PV) panel, a modified bitumen (MODBIT) substrate, a roll good, a board (such as but not limited to at least one of a foam board (e.g., a polyisocyanurate (ISO) foam board), a cover board, or any combination thereof), a pipe, a base sheet, a chimney, a wax paper, or any combination thereof.

As used herein, a "low slope" roof or roof deck has a pitch of Y/X, where Y and X are in a ratio of 4:12 or less, where Y corresponds to the "rise" of the roof or roof deck, and where X corresponds to the "run" of the roof or roof deck.

In some embodiments, the present invention provides a building envelope membrane with an adhesive layer on each of two sides of a membrane layer (e.g., a top adhesive layer and a bottom adhesive layer). In some embodiments, one of the adhesive layers (e.g., the bottom adhesive layer) adheres the building envelope membrane to a building structure, such as a low slope roof deck and/or an external wall. In some embodiments, one of the adhesive layers (e.g., the top adhesive layer) adheres a building component to the building envelope membrane that is adhered to the building structure.

In some embodiments, one or both of the adhesive layers are at least partially covered by release liners (e.g., a top release liner and a bottom release liner). In some embodiments, one of the release liners (e.g., the bottom release liner) is at least partially removed to at least partially expose the adhesive layer that adheres the building envelope membrane to the building structure. In some embodiments, one of the release liners (e.g., the top release liner) is at least partially removed to at least partially expose the adhesive layer that adheres the building component to the building envelope membrane.

In some embodiments, at least one of the release liners (e.g., the top release liner) includes a UV stabilizer. In some embodiments, at least one of the release liners (e.g., the top release liner) is not removed immediately after the building envelope membrane is installed on the building structure, but instead the release liner remains exposed to an external environment for a period, such as up to 180 days in some embodiments. In some embodiments, at least one of the release liners (e.g., the top release liner) is at least partially removed after the exposure to the external environment, and the building component is adhered to the building envelope membrane. In some embodiments, the building envelope membrane is used during a phased construction project, in which the building envelope membrane is installed on the building structure, thereby protecting the building structure, and thereafter, the building component is adhered to the building envelope membrane.

Figure 2:
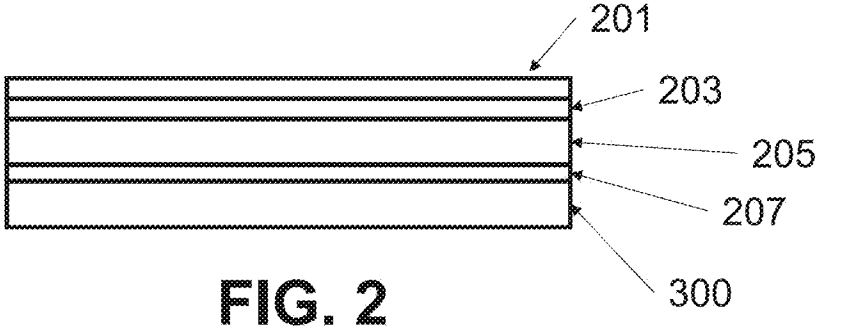
FIG. 2 is a schematic cross-sectional view of the building system, taken along line II-II in FIG. 1, in accordance with some embodiments.
Figure 3:
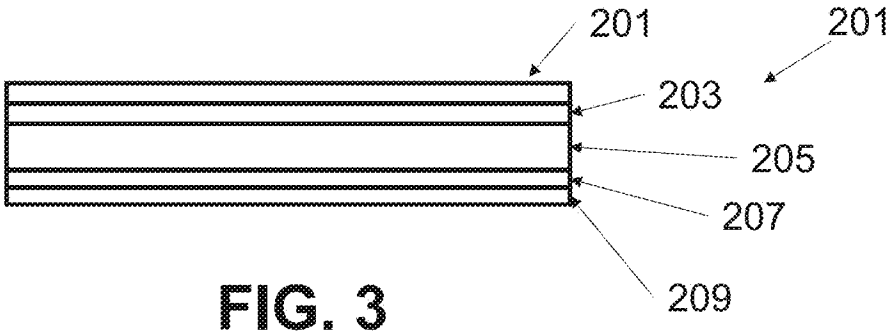
FIG. 3 is a cross-sectional view of the building envelope membrane of FIGS. 1 and 2 prior to installation on the building structure, in accordance with some embodiments.

With reference to the drawings, FIG. 1 is a top schematic view of a building system 100 including a building envelope membrane 200 installed on a building structure 300, FIG. 2 is a schematic cross-sectional view of the building system 100, taken along line II-II in FIG. 1, and FIG. 3 is a cross-sectional view of the building envelope membrane 200 of FIGS. 1 and 2 prior to installation on the building structure, in accordance with some embodiments. In some embodiments, the building structure 300 is a low slope roof deck. In some embodiments, the roof deck is not a low slope roof deck. In some embodiments, the roof deck includes at least one of a wood material, a metal material, a concrete material, and/or a gypsum material. In some embodiments, a surface of the roof deck, on which the building envelope membrane 200 is installed, is relatively flat. In some embodiments, the surface of the roof deck is corrugated. In some embodiments, the external wall includes at least one of a wood material, a metal material, a concrete material, and/or a gypsum material. In some embodiments, a surface of the external wall, on which the building envelope membrane 200 is installed, is relatively flat.

As the figures show, in some embodiments, the building envelope membrane 200 includes a first release liner 201. As shown, in some embodiments, the first release liner 201 is an outer layer of the building envelope membrane 200 when the building envelope membrane 200 is installed on the building structure 300. In some embodiments, the first release liner 201 is removable from the building envelope membrane 200. In some embodiments, after installation of the building envelope membrane 200 on the building structure 300, at least a portion of the first release liner 201 is removed from the building envelope membrane 200 to adhere a building component to the building envelope membrane 200, as further described. In some embodiments, the first release liner 201 is a split film release liner.

In an alternative embodiment with respect to a building envelope, with reference to the drawings, FIG. 1 is a top schematic view of a building system 100 including a building envelope membrane 200 installed on an external wall 300, FIG. 2 is a schematic cross-sectional view of the building system 100, taken along line II-II in FIG. 1, and FIG. 3 is a cross-sectional view of the building envelope membrane 200 of FIGS. 1 and 2 prior to installation on the external wall 300, in accordance with some embodiments. In some embodiments, the external wall 300 includes at least one of a wood material, a metal material, a concrete material, and/or a gypsum material As the figures show, in the alternative embodiments, the building envelope membrane 200 includes a first release liner 201. As shown, in some embodiments, the first release liner 201 is an outer layer of the building envelope membrane 200 when the building envelope membrane 200 is installed on the external wall 300. In some embodiments, the first release liner 201 is removable from the building envelope membrane 200. In some embodiments, after installation of the building envelope membrane 200 on the building structure 300, at least a portion of the first release liner 201 is removed from the building envelope membrane 200 to adhere a building component to the building envelope membrane 200, as further described. In some embodiments, the first release liner 201 is a split film release liner.

In some embodiments, the first release liner 201 includes a first polymer, and a UV stabilizer. In some embodiments, the first polymer includes at least one of polyethylene, such as but not limited to high-density polyethylene (HDPE), medium-density polyethylene (MDPE), and/or low-density polyethylene (LDPE); polypropylene (PP); polyvinyl chloride (PVC); and/or ethylene vinyl acetate (EVA), and/or any combinations thereof.

In some embodiments, the UV stabilizer includes at least one of a UV absorber, a hinder amine light stabilizer, an anti-oxidant pigment, and/or an anti-oxidant carrier (e.g., one or more of polypropylene (PP), polyethylene (PE), and/or isotactic polypropylene (IPP)), and/or combinations thereof.

In some embodiments, the first release liner 201 includes 1 wt. % to 90 wt. % of the UV stabilizer based on a total weight of the first release liner. In some embodiments, the wt. % is 5 wt. %. In some embodiments, the wt. % is 10 wt. %. In some embodiments, the wt. % is 25 wt. %. In some embodiments, the wt. % is 50 wt. %. In some embodiments, the first release liner 201 includes a sufficient amount of the UV stabilizer, such that, when tested in accordance with the weathering test used to test for exposure for 180 days, the first release liner 201 passes the weathering test. Thus, in some embodiments, the first release liner 201 may remain as the outer layer of the building envelope membrane 200, exposed to an external environment for a time period of up to and including 180 days, when the building envelope membrane 200 is installed on the building structure 300.

In some embodiments, the first release liner 201 further includes, in addition to the UV stabilizer, at least one of an antioxidant, a process stabilizer, a thermal stabilizer, and/or a UV absorber, and/or combinations thereof. In some embodiments, the antioxidant includes a phenolic antioxidant. In some embodiments, the antioxidant includes pentaerythritol tetrakis(3-(3,5-di-tert-butyl-4-hydroxyphenyl) propionate).

In some embodiments, the building envelope membrane 200 includes a first adhesive layer 203. In some embodiments, the first adhesive layer 203 includes at least one of an epoxy adhesive, a polyurethane adhesive, an acrylic adhesive, an ultraviolet radiation cured adhesive, a silicone-containing adhesive, a silyl modified polymer, a silane terminated polymer, natural rubber, a polyolefin polymer, a poly-alpha-olefin (APAO/APO) polymer, a polyamide polyvinyl acetate, a polyvinyl alcohol, an ethylene vinyl acetate, a styrene, a styrene-isoprene-styrene polymer (SIS), a styrene-butadiene-styrene polymer (SBS), a styrene-ethylene/butylene-styrene polymer (SEBS), a styrene-butadiene rubber (SBR), a polyamide, a polyester, a polyester amide, an ethylene acrylic, a butyl rubber, and/or a butyl adhesive, and/or any combination thereof.

In some embodiments, because the first release liner 201 include the UV stabilizer, and withstands weathering, the first release liner 201 protects the first adhesive layer 203 from degradation that would result from exposure to the external environment, after installation of the building envelope membrane 200 on the building structure 300 but before installation of the building component on the building envelope membrane 200.

In some embodiments, as FIGS. 1-3 show, the building envelope membrane 200 includes a membrane layer 205. In some embodiments, the membrane layer 205 includes a polymer. In some embodiments, the polymer includes one or more of polyethylene (PE), thermoplastic polyolefin (TPO), polyvinyl chloride (PVC), polyethylene terephthalate (PET), and/or polypropylene (PP), and/or any combination thereof.

In some embodiments, as the figures show, the first adhesive layer 203 is positioned between the first release liner 201 and the membrane layer 205. Thus, in some embodiments, removing at least a portion of the first release liner 201 exposes at least a portion of the first adhesive layer 203.

With reference to FIGS. 1-3, in some embodiments, the building envelope membrane 200 includes a second adhesive layer 207. In some embodiments, the second adhesive layer 207 includes one or more of the adhesives listed above for the first adhesive layer 203. In some embodiments, the adhesive of the first adhesive layer 203 is the same as the adhesive of the second adhesive layer 207. In some embodiments, the first adhesive layer 203 is different than the second adhesive layer 207.

As the figures show, in some embodiments, the membrane layer 205 is positioned between the first adhesive layer 203 and the second adhesive layer 207. In some embodiments, as FIG. 2 shows, the second adhesive layer 207 contacts the building structure 300, thereby adhering and installing the building envelope membrane 200 to the building structure 300.

In some embodiments, as FIGS. 2 and 3 show, the membrane layer 205 is a single layer. In some embodiments, as discussed in more detail below, the membrane layer 205 is multiple layers (e.g., the membrane layer 205 is a multi-layer membrane layer). In some embodiments, the membrane layer 205 is a vapor retarder membrane layer. In some embodiments, the vapor retarder membrane layer is a single layer. In some embodiments, the vapor retarder membrane layer is a multi-layer membrane layer. In some embodiments, the multi-layer membrane layer includes two layers, three layers, four layers, five layers, six layers, or more than six layers.

With reference to FIG. 3, in some embodiments, before installation of the building envelope membrane 200 on the building structure 300, the building envelope membrane 200 includes a second release liner 209. In some embodiments, at least a portion of the second release liner 209 is removable from the building envelope membrane, thereby exposing at least a portion of the second adhesive layer 207. Thus, in some embodiments, to install the building envelope membrane 200 on the building structure 300, at least a portion of the second release liner 209 is removed to expose at least a portion of the second adhesive layer 207. In some embodiments, the exposed portion of the second adhesive layer 207 adheres the building envelope membrane 200 to the building structure 300, thereby installing the building envelope membrane 200 on the building structure 300.

In some embodiments, the second release liner 209 includes a polymer. In some embodiments, the polymer of the second release liner 209 is one or more of the polymers listed above for the first release liner 201. In some embodiments, the polymer of the first release liner 201 is the same as the polymer of the second release liner 209. In some embodiments, the first release liner 201 is different than the second release liner 209. In some embodiments, the second release liner 209 is a split film release liner.

In some embodiments, the second release liner 209 includes a UV stabilizer. In some embodiments, the UV stabilizer of the second release liner 209 is one or more of the UV stabilizers listed above for the first release liner 201. In some embodiments, the UV stabilizer of the first release liner 201 is the same as the UV stabilizer of the second release liner 209. In some embodiments, the UV stabilizer of the first release liner 201 is different than the UV stabilizer of the second release liner 209. In some embodiments, the second release liner 209 includes less UV stabilizer than the first release liner 201. In some embodiments, the second release liner 209 omits a UV stabilizer. In some embodiments, the second release liner 209 is unable to pass the weathering test.

Figure 4:
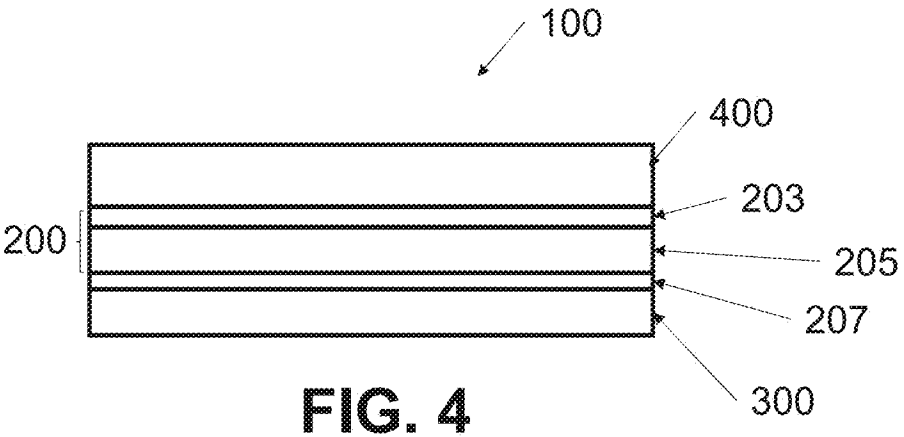
FIG. 4 is a cross-sectional view of the building system including the building envelope membrane installed on the building structure, and a building component installed on the building envelope membrane, in accordance with some embodiments.

FIG. 4 is a cross-sectional view of the building system 100 including the building envelope membrane 200 installed on the building structure 300, and a building component 400 installed on the building envelope membrane 200, in accordance with some embodiments. As FIG. 4 shows, in some embodiments, after the first release liner is removed, the building component 400 is installed on the first adhesive layer 203 of the building envelope membrane 200. Thus, in some embodiments, at least a portion of the first release liner 201 is removed from the building envelope membrane 200, thereby exposing at least a portion of the first adhesive layer 203. The building component 400 is positioned on the exposed portion of the first adhesive layer 203, and the exposed portion of the first adhesive layer 203 adheres the building component 400 to the building envelope membrane 200, which is adhered to the building structure 300. In some embodiments, the building component 400 includes at least one of a photovoltaic (PV) panel, a modified bitumen (MODBIT) substrate, a roofing shingle, an oriented strand board (OSB), a roll good, a board (such as but not limited to at least one of a foam board (e.g., a polyisocyanurate (ISO) foam board), a coverboard, a fiberglass insulation board or any combination thereof), a fire retardant board, a hail resistant board, a high density cover board, and/or a cement board, and/or any combination thereof. In some embodiments, the building component 400 is installed without piercing or penetrating any surface or layer of the building envelope membrane 200, such as with a nail, screw, staple, clip, or other fastener. In some embodiments, the building component 400 is installed, in addition to adhering, by fastening, such as with a nail, screw, staple, clip, or other fastener.

Figure 5:
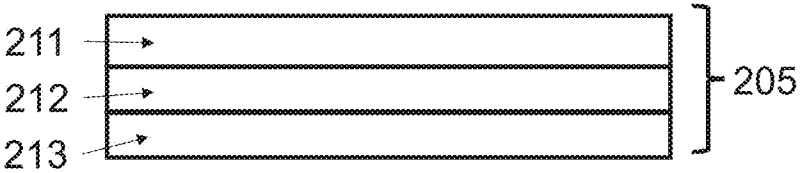
FIG. 5 is a schematic cross-sectional view of the membrane layer, in accordance with some embodiments.

FIG. 5 is a schematic cross-sectional view of the membrane layer 205, in accordance with some embodiments. Returning to FIGS. 2 and 3, in some embodiments, the membrane layer 205 includes a single layer. As FIG. 5 shows, in some embodiments, the membrane layer 205 includes more than one layer. In some embodiments, the membrane layer 205 includes a first membrane layer 211, a second membrane layer 212, and a third membrane layer 213, wherein the second membrane layer 212 is between the first membrane layer 211 and the third membrane layer 213. It is to be understood that, in some embodiments, the membrane layer 205 includes a greater number or a lesser number than three layers.

In some embodiments, at least one of the first membrane layer 211 and/or the third membrane layer 213 includes a polymer. In some embodiments, the polymer includes one or more of the polymers listed above for the membrane layer 205. In some embodiments, the second membrane layer 212 includes at least one of a solid polymer layer and/or a woven polymer layer. In some embodiments, the polymer of the solid and/or woven polymer layer includes one or more of the polymers listed above for the membrane layer 205.

Figure 8:
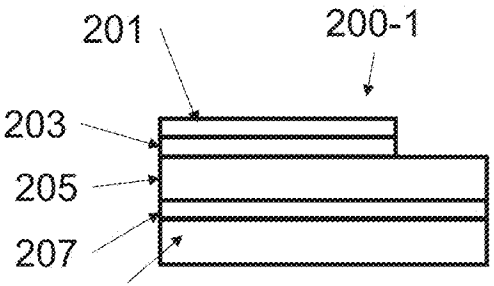
FIG. 8 is a schematic cross-sectional view of the building system, taken along line VIII-VIII in FIG. 6, in accordance with some embodiments.
Figure 6:
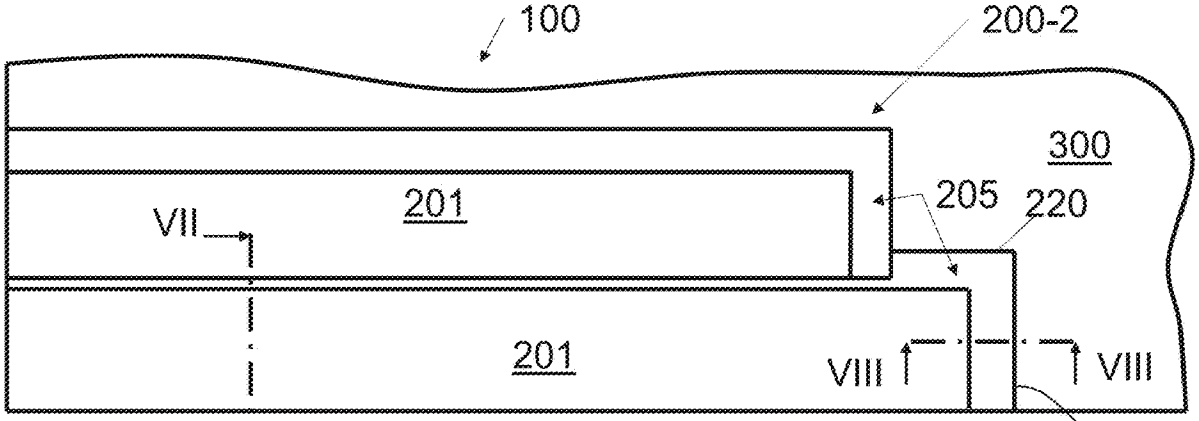
FIG. 6 is a top schematic view of the building system including two building envelope membranes installed on a building structure, in accordance with some embodiments.
Figure 7:
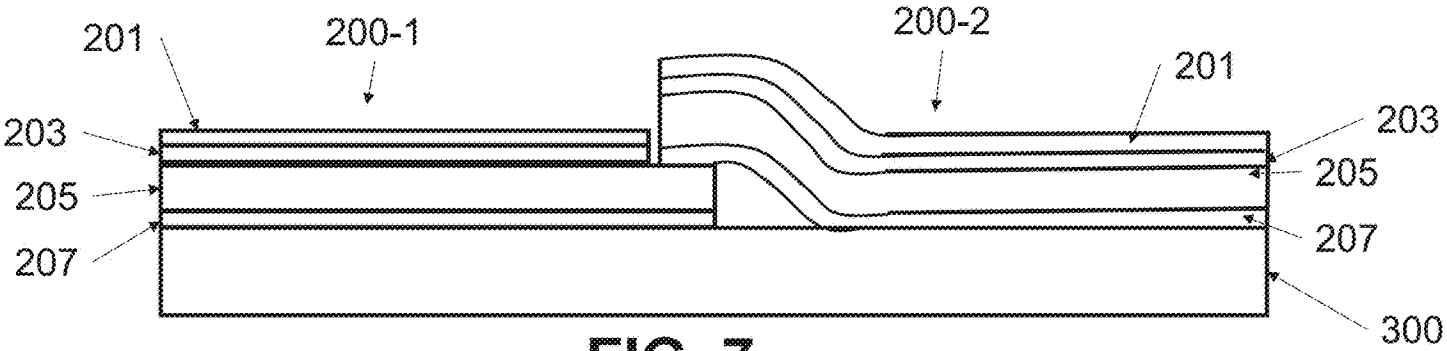
FIG. 7 is a schematic cross-sectional view of the building system, taken along line VII-VII in FIG. 6, in accordance with some embodiments.

FIG. 6 is a top schematic view of the building system 100 including two building envelope membranes 200 installed on the building structure 300, FIG. 7 is a schematic cross-sectional view of the building system 100 taken along line VII-VII in FIG. 6, and FIG. 8 is a schematic cross-sectional view of the building system 100 taken along line VIII-VIII in FIG. 6, in accordance with some embodiments. As FIGS. 6-8 show, in some embodiments, the building envelope membrane 200 includes one or more selvage edges, as further described below.

For example, as shown in FIGS. 6-8, in some embodiments a first one of the building envelope membranes 200, designated as first building envelope membrane 200-1, is installed on the building structure 300. A second one of the building envelope membranes 200, designated as second building envelope membrane 200-2, is then installed on the building structure 300, such that at least a portion of the second adhesive layer 207 of the second building envelope membrane 200-2 overlaps an edge of the first building envelope membrane 200-1. In some embodiments, because the first release liner 201 and the first adhesive layer 203 do not extend to a machine-direction edge of the building envelope membrane 200, the building envelope membrane 200 provides a selvage edge 220 on the membrane layer 205, over which the subsequently installed building envelope membrane 200 overlaps. Thus, as FIGS. 6 and 7 show, in some embodiments, the second building envelope membrane 200-2 does not overlap either the first release liner 201 or the first adhesive layer 203 of the first building envelope membrane 200-1, but instead the second building envelope membrane 200-2 overlaps the membrane layer 205 of the first building envelope membrane 200-1.

As FIGS. 6-8 also show, in some embodiments, the first release liner 201 and the first adhesive layer 203 do not extend to a cross-direction edge of the building envelope membrane 200. Thus, in some embodiments, the building envelope membrane 200 provides a selvage edge 222 on the membrane layer 205, over which another one of the building envelope membranes 200 overlaps when installed in the same row. Although FIGS. 6 through 8 show the selvage edge 222 on only one cross-direction edge of the building envelope membrane 200, in some embodiments, one or more, or all, of the building envelope membranes 200 include selvage edges on both cross-direction edges, either with or without the selvage edge 220 on the machine-direction edge.

In some embodiments, one or more of the selvage edges 220, 222 has a width of 1 inch. In some embodiments, the width is 2 inches. In some embodiments, the width is 3 inches. In some embodiments, the width is 4 inches. In some embodiments, the width is 5 inches. In some embodiments, the width is 6 inches. In some embodiments, the width is 7 inches. In some embodiments, the width is 8 inches. In some embodiments, the width is more than 8 inches. In some embodiments, the width is 1 inch to 8 inches. In some embodiments, the width is 1 inch to 7 inches. In some embodiments, the width is 1 inch to 6 inches. In some embodiments, the width is 1 inch to 5 inches. In some embodiments, the width is 2 inches to 8 inches. In some embodiments, the width is 2 inches to 7 inches. In some embodiments, the width is 2 inches to 6 inches. In some embodiments, the width is 3 inches to 8 inches. In some embodiments, the width is 3 inches to 7 inches. In some embodiments, the width is 4 inches to 8 inches.

In some embodiments, one or more of the layers of the building envelope membrane 200 are laminated to one another. For example, in some embodiments, when the membrane layer 205 includes one or more layers, one or more of the layers are laminated to one another. In some embodiments, one or more layers of the building envelope membrane 200 are adhered to one another. In some embodiments, the adhesive adhering the layers is one or more of the listed adhesives. Thus, in some embodiment, the building envelope membrane 200 includes one or more adhesive, and/or one or more adhesive layers, between the first membrane layer 211 and the second membrane layer 212, and/or between the second membrane layer 212 and the third membrane layer 213.

In accordance with the above discussion, in some embodiments the disclosure provides a method, such as a method of installing the building envelope membrane 200. In some embodiments, the method includes obtaining the building envelope membrane 200. In some embodiments, the method includes removing at least a portion of the second release liner 209, thereby exposing at least a portion of the second adhesive layer 207. In some embodiments, the method includes adhering the building envelope membrane 200 to the building structure 300 with the exposed portion of the second adhesive layer 207.

In some embodiments, the method includes removing at least a portion of the first release liner 201, thereby exposing at least a portion of the first adhesive layer 203. In some embodiments, the method includes removing at least a portion of the first release liner 201 after a specified time wherein the specified time is at least 1 to 180 days. In some embodiments, the number of days is 10 to 150 days. In some embodiments, the number of days is 20 to 125 days. In some embodiments, the number of days is 50 to 100 days. In some embodiments, the method includes adhering the building component 400 to the exposed portion of the first adhesive layer 203.

In some embodiments, after the first release liner 201 is removed after the specified time, a building component 400 is installed on the building envelope membrane 200. In some embodiments, after the first release liner 201 is removed, a building component 400 is directly installed on the building envelope membrane 200. In some embodiments, the building component 400 comprises an insulation board (e.g., polyiso board). In some embodiments, the building component 400 includes at least one of a photovoltaic (PV) panel, a PV integrated shingle, a modified bitumen (MODBIT) substrate, a roofing shingle, an oriented strand board (OSB), a roll good, a board (such as but not limited to at least one of a foam board (e.g., a polyisocyanurate (ISO) foam board), a coverboard, a fiberglass insulation board or any combination thereof), a fire retardant board, a hail resistant board, a high density cover board, and/or a cement board, and/or any combination thereof.

In some embodiments, the building envelope membrane 200 is sold as a roll, sheet or any combination thereof.

Figure 9:
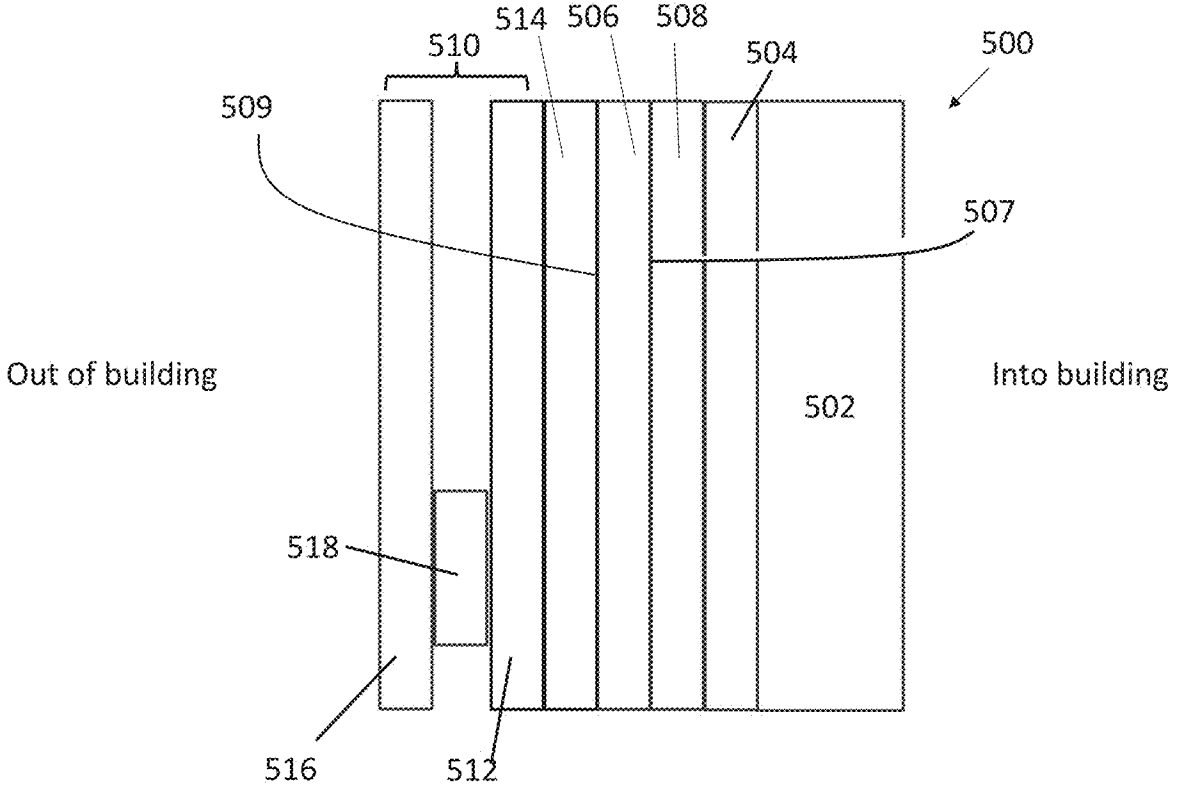
FIG. 9 is a schematic cross-sectional view of a wall assembly of a building system, in accordance with some embodiments.

Referring to FIG. 9, in some embodiments, a wall assembly 500 for a building structure or building system is illustrated. In some embodiments, the wall assembly 500 includes framing 502. In some embodiments, the framing 502 includes at least one stud. In some embodiments, the framing 502 includes a plurality of studs. In some embodiments, the studs are composed of wood. In some embodiments, the studs are composed of metal. In some embodiments, the studs are composed of steel.

In some embodiments, the wall assembly 500 includes a structural board 504. In some embodiments, the structural board 504 is attached to the framing 502. In some embodiments, the structural board 504 is attached to the framing 502 by fasteners or an adhesive. In some embodiments, the structural board 504 is a gypsum (drywall) panel. In some embodiments, the structural board 504 is a wood panel. In some embodiments, the structural board 504 is plywood. In some embodiments, the structural board 504 is a magnesium oxide (MgO) board. In some embodiments, the structural board 504 is an oriented strand board. In some embodiments, the structural board 504 is a structural insulated panel. In some embodiments, the structural board 504 is structural composite lumber. In some embodiments, the structural board 504 is a structural concrete panel. In some embodiments, the structural board 504 is a structural sheathing.

In some embodiments, the wall assembly 500 includes a membrane layer 506. In some embodiments, the membrane layer 506 includes at least one layer. In some embodiments, the membrane layer 506 includes a plurality of layers. In some embodiments, the membrane layer 506 may include a structure, composition, function, features, and/or components of the membrane layer 205 described above. In some embodiments, the membrane layer 506 includes a vapor retarder membrane layer. In some embodiments, the vapor retarder membrane layer is a double-sided vapor retarder membrane layer. In some embodiments, the vapor retarder membrane layer is vapor impermeable. In some embodiments, the vapor retarder membrane layer is vapor permeable. In some embodiments, the membrane layer 506 includes a first surface 507 and a second surface 509 opposite the first surface 507. In some embodiments, the membrane layer 506 is attached to the structural board 504. In some embodiments, the first surface 507 of the membrane layer 506 contacts the structural board 504. In some embodiments, the first surface 507 of the membrane layer 506 directly contacts the structural board 504. In some embodiments, the membrane layer 506 is attached to the structural board 504 by a first adhesive layer 508. In some embodiments, the first adhesive layer 508 is on the first surface 507 of the membrane layer 506. In some embodiments, the first adhesive layer 508 is composed of any one of the first adhesive layer 203 and/or the second adhesive layer 207 described above.

In some embodiments, the wall assembly 500 includes a building component 510. In some embodiments, the building component 510 includes a first layer 512. In some embodiments, the first layer 512 includes an insulation board. In some embodiments, the insulation board is a polyiso board. In some embodiment, the insulation board is composed primarily of stone wool. In some embodiments, the first layer 512 is attached to the membrane layer 506. In some embodiments, the first layer 512 contacts the second surface 509 of the membrane layer 506. In some embodiments, the first layer 512 directly contacts the second surface 509 of the membrane layer 506. In some embodiments, the first layer 512 is attached to the membrane layer 506 by at least one second adhesive layer 514. In some embodiments, the first layer 512 is attached to the second surface 509 of the membrane layer 506 by the at least one second adhesive layer 514. In some embodiments, the at least one second adhesive layer 514 is composed of any one of the first adhesive layer 203 and/or the second adhesive layer 207 described above. In some embodiments, the at least one second adhesive layer 514 includes a plurality of second adhesive layers 514. In some embodiments, the at least one second adhesive layer 514 is on the second surface 509 of the membrane layer 506.

In some embodiments, the building component 510 includes a second layer 516. In some embodiments, the second layer 516 is cladding. In some embodiments, the cladding is composed of one or more of wood or timber, metal, stone, brick, composite materials, fiber cement, glass, or a polymer. In some embodiments, the second layer 516 is attached to the first layer 512. In some embodiments, the second layer 516 contacts the first layer 512. In some embodiments, the second layer 516 directly contacts the first layer 512. In some embodiments, the second layer 516 is attached to the first layer 512 by at least one fastener 518. In some embodiments, the second layer 516 is attached to the first layer 512 by a plurality of fasteners 518. In some embodiments, one or more of the fasteners 518 includes screws, rivets, bolts, nails, pin members, rods, staples, or clips. In some embodiments, the second layer 516 is attached to the first layer 512 by an adhesive. In some embodiments, the second layer 516 is spaced from the first layer 512. In some embodiments, a first release liner is attached to at least the first adhesive layer 508 prior the installation of the structural board 504 to the framing 502. In some embodiments, the first release liner is removed prior to the installation of the structural board 504 to the framing 502 to expose the first adhesive layer 508. In some embodiments, the first release liner has a structure, function, composition and/or features similar to those of the release liner 201 and/or the release liner 209.

In some embodiments, a second release liner is attached to the at least one second adhesive layer 514 prior the installation of the building component 510 to the membrane layer 506. In some embodiments, the second release liner is removed prior the installation of the building component 510 to the membrane layer 506 to expose the at least one second adhesive layer 514. In some embodiments, the first release liner has a structure, function, composition and/or features similar to those of the release liner 201 and/or the release liner 209.

Figure 10B:
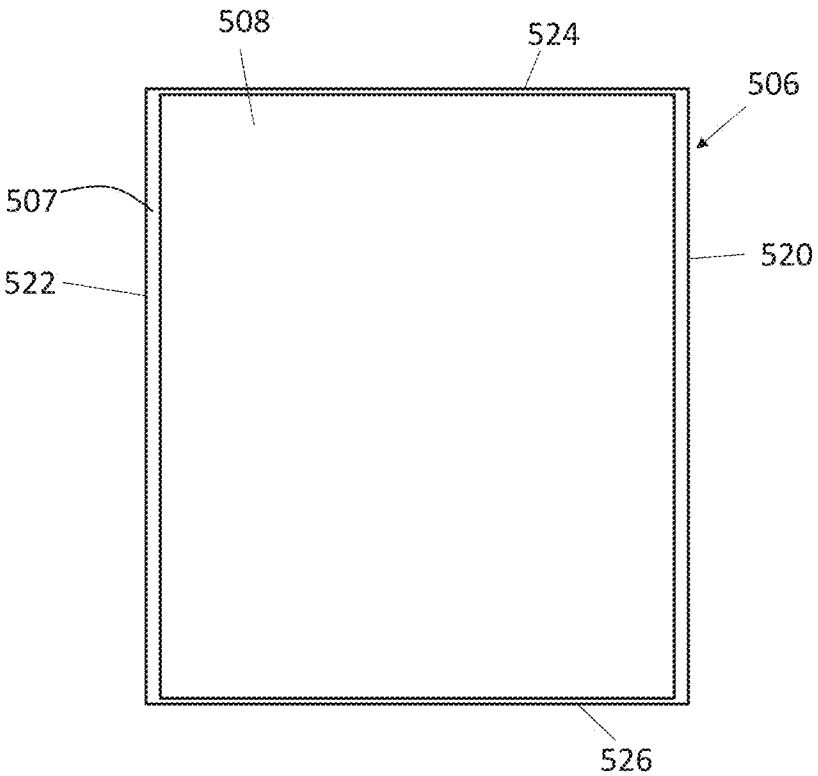
FIGS. 10A and 10B are schematic outer and inner plan views of a wall assembly of a building system, in accordance with some embodiments.
Figure 10A:
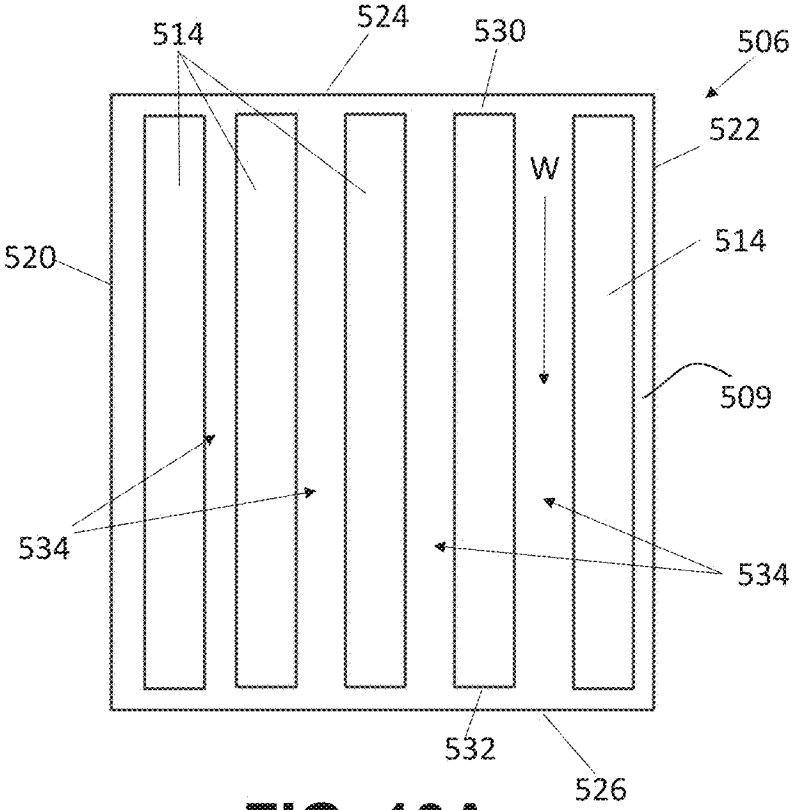

Referring to FIG. 10A, in some embodiments, the membrane layer 506 includes a first end 520, a second end 522 opposite the first end 520, a third end 524 extending from the first end 520 to the second end 522, and a fourth end 526 opposite the third end 524 and extending from the first end 520 to the second end 522. In some embodiments, the second surface 509 extends from the first end 520 to the second end 522 and from the third end 524 to the fourth end 526. In some embodiments, the membrane layer 506 is vapor impermeable. In some embodiments, the membrane layer 506 is vapor permeable. In some embodiments, the at least one second adhesive layer 514 is on at least a portion of the second surface 509 of the membrane layer 506. In some embodiments, the at least one second adhesive layer 514 includes a plurality of the second adhesive layers 514. In some embodiments, the plurality of second adhesive layers 514 include a plurality of stripes. In some embodiments, each of the plurality of stripes is rectangular in shape. In some embodiments, each of the plurality of stripes is oblong. In some embodiments, each the plurality of second adhesive layers 514 may include other shapes or sizes, such as square, elliptical, oval, circular, triangular, wedge, polygonal, diamond, or non-polygonal. In some embodiments, the plurality of second adhesive layers 514 is arranged in a pattern. In some embodiments, the plurality of second adhesive layers 514 is arranged in a matrix or an array. In some embodiments, each of the plurality of second adhesive layers 514 includes a first end 530 located at or proximate to the first end 524 of the membrane layer 506 and a second end 532 opposite the first end 530 and located at or proximate to the second end 526 of the membrane layer 506. In some embodiments, at least one channel 534 is located between a corresponding pair of adjacent ones of the second adhesive layers 514. In some embodiments, the at least one channel 534 includes a plurality of channels 534. In some embodiments, each of the plurality of channels 534 is located between a corresponding pair of adjacent ones of the second adhesive layers 514. In some embodiments, the at least one channel 534 facilitates drainage of water W through the wall assembly 500 in a vertical or angled direction.

Referring to FIG. 10B, in some embodiments, the first surface 507 extends from the first end 520 to the second end 522 and from the third end 524 to the fourth end 526 of the membrane layer 506. In some embodiments, the first adhesive layer 508 is on at least a portion of the first surface 507 of the membrane layer 506. In some embodiments, the first adhesive layer 508 is on substantially the entirety of the first surface 507 of the membrane layer 506. In some embodiments, the first adhesive layer 508 is on a majority of the first surface 507 of the membrane layer 506. In some embodiments, the first adhesive layer 508 is on the entirety of the first surface 507 of the membrane layer 506.

In some embodiments, the wall assembly 500 is vapor permeable. In some embodiments, the wall assembly 500 is vapor impermeable.

Figure 11B:
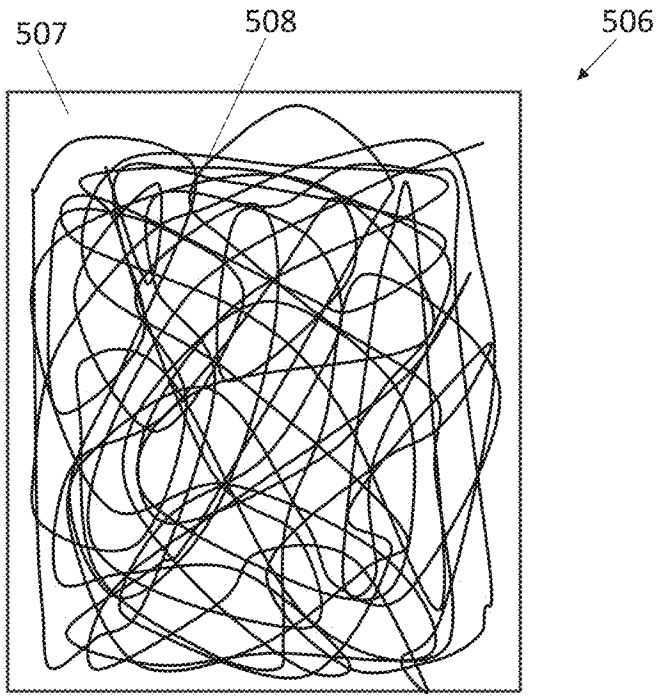
FIGS. 11A and 11B are schematic outer and inner plan views of a wall assembly of a building system, in accordance with some embodiments.
Figure 11A:
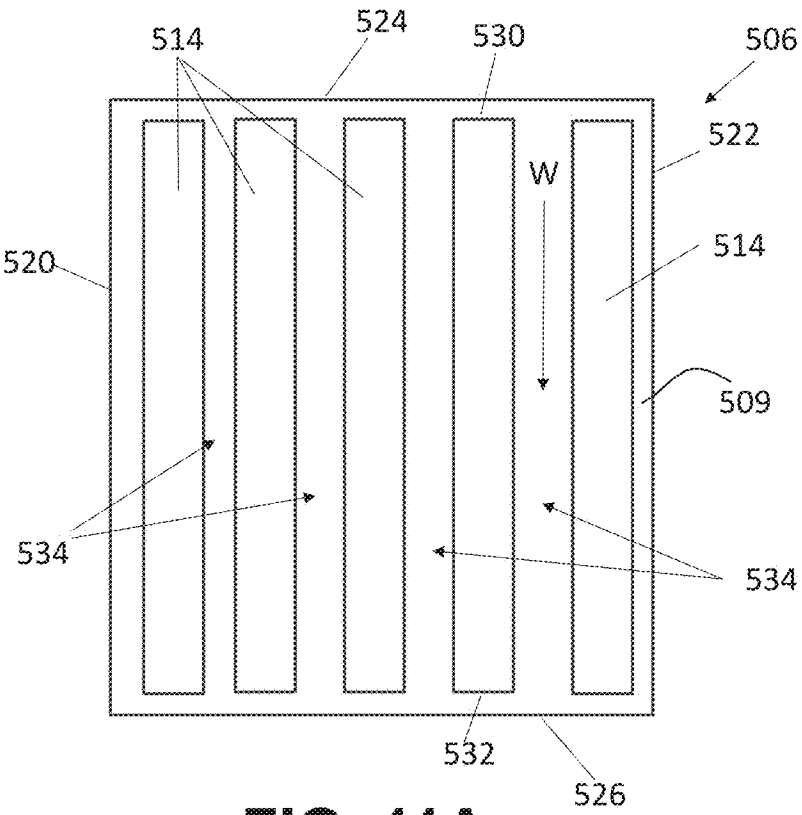

Referring to FIG. 11A, in some embodiments, the membrane layer 506 includes an identical or a similar structure, function, composition, components, and/or features of the membrane layer 506 illustrated in FIG. 10A. In some embodiments, the membrane layer 506 is vapor permeable. Referring to FIG. 11B, in some embodiments, the first adhesive layer 508 is on at least a portion of the first surface 507 of the membrane layer 506. In some embodiments, the first adhesive layer 508 has a tornadic design and shape, e.g., characteristics, size and shape of a "tornado" or spiral. In some embodiments, the first adhesive layer 508 has a randomized, tangled or entangled string pattern. In some embodiments, the pattern of the first adhesive layer 508 distributes stress on the wall assembly 500.

Figure 12B:
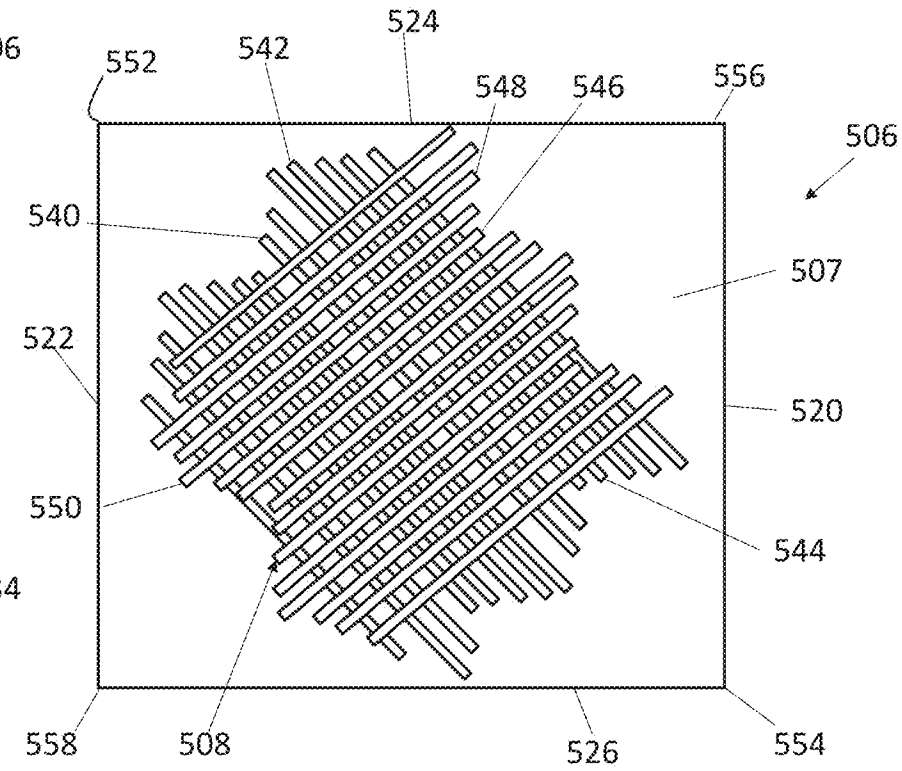
FIGS. 12A and 12B are schematic outer and inner plan views of a wall assembly of a building system, in accordance with some embodiments.
Figure 12A:
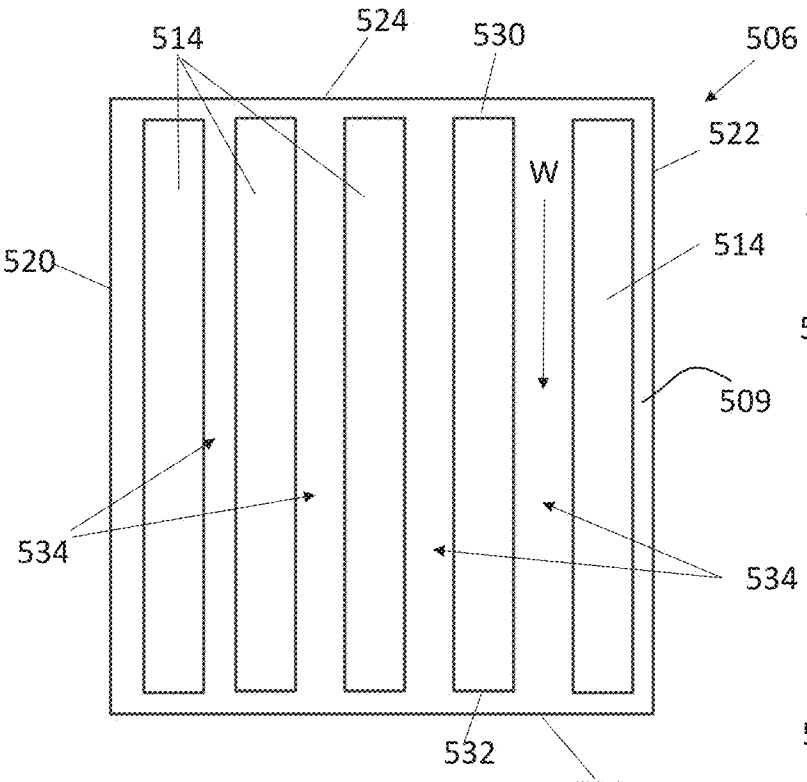

Referring to FIG. 12A, in some embodiments, the membrane layer 506 includes an identical or a similar structure, function, composition, components, and/or features of the membrane layer 506 illustrated in FIGS. 10A and 11A. In some embodiments, the membrane layer 506 is vapor permeable.

Referring to FIG. 12B, in some embodiments, the first adhesive layer 508 is on at least a portion of the first surface 507 of the membrane layer 506. In some embodiments, the first adhesive layer 508 has a diamond pattern. In some embodiments, the diamond pattern includes a first plurality of stripes 540. In some embodiments, each of the first plurality of stripes 540 includes a first end 542 and a second end 544 opposite the first end 542. In some embodiments, the first plurality of stripes 540 includes a first length from the first end 542 to the second end 544. In some embodiments, the lengths of one or more of the first plurality of stripes 540 are equal or substantially equal to one another. In some embodiments, the lengths of all of the first plurality of stripes 540 are equal or substantially equal to one another. In some embodiments, the lengths of one or more of the first plurality of stripes 540 are different from one another.

In some embodiments, the first ends 542 of one or more of the first plurality of stripes 540 are parallel or substantially parallel to one another. In some embodiments, the first ends 542 of all of the first plurality of stripes 540 are parallel or substantially parallel to one another. In some embodiments, the first ends 542 of one or more of the first plurality of stripes 540 are not parallel to one another.

In some embodiments, the second ends 544 of one or more of the first plurality of stripes 540 are parallel or substantially parallel to one another. In some embodiments, the second ends 544 of all of the first plurality of stripes 540 are parallel or substantially parallel to one another. In some embodiments, the second ends 544 of one or more of the first plurality of stripes 540 are not parallel to one another. In some embodiments, all of the first plurality of stripes 540 are parallel to one another. In some embodiments, substantially all of the first plurality of stripes 540 are parallel to one another. In some embodiments, a majority of the first plurality of stripes 540 are parallel to one another. In some embodiments, some of the first plurality of stripes 540 are parallel to one another.

In some embodiments, each of the first plurality of stripes 540 extends in a first direction. In some embodiments, the first direction is a longitudinal direction from the third end 524 to the fourth end 526 of the membrane layer 506. In some embodiments, the first direction is a lateral direction from the first end 520 to the second end 522 of the membrane layer 506. In some embodiments, the first direction is oblique relative to the longitudinal direction and/or the lateral direction. In some embodiments, the oblique, first direction extends from or proximate a first corner 552 at an intersection of the second end 522 and the third end 524 to or proximate a second corner 554 at an intersection of the first end 520 to the fourth end 526.

In some embodiments, the diamond pattern includes a second plurality of stripes 546. In some embodiments, each of the second plurality of stripes 546 includes a first end 548 and a second end 550 opposite the first end 548. In some embodiments, each of the second plurality of stripes 546 includes a second length from the first end 548 to the second end 550. In some embodiments, the second lengths of one or more of the second plurality of stripes 546 are equal or substantially equal to one another. In some embodiments, the second lengths of all of the second plurality of stripes 546 are equal or substantially equal to one another. In some embodiments, the second lengths of one or more of the second plurality of stripes 546 are different from one another.

In some embodiments, the first ends 548 of one or more of the second plurality of stripes 546 are parallel or substantially parallel to one another. In some embodiments, the first ends 548 of all of the second plurality of stripes 546 are parallel or substantially parallel to one another. In some embodiments, the second ends 548 of one or more of the second plurality of stripes 546 are not parallel to one another.

In some embodiments, the second ends 550 of one or more of the second plurality of stripes 546 are parallel or substantially parallel to one another. In some embodiments, the second ends 550 of all of the second plurality of stripes 546 are parallel or substantially parallel to one another. In some embodiments, the second ends 550 of one or more of the second plurality of stripes 546 are not parallel to one another. In some embodiments, all of the second plurality of stripes 546 are parallel to one another. In some embodiments, substantially all of the second plurality of stripes 546 are parallel to one another. In some embodiments, a majority of the second plurality of stripes 546 are parallel to one another. In some embodiments, some of the second plurality of stripes 546 are parallel to one another.

In some embodiments, each of the second plurality of stripes 546 extends in a second direction. In some embodiments, the second direction is different from the first direction of the first plurality of stripes 540. In some embodiments, the second direction is the longitudinal direction from the third end 524 to the fourth end 526 of the membrane layer 506. In some embodiments, the second direction is the lateral direction from the first end 520 to the second end 522 of the membrane layer 506. In some embodiments, the first direction is oblique relative to the longitudinal direction and/or the lateral direction. In some embodiment, the oblique, first direction extends from or proximate a third corner 556 at the intersection of the first end 520 and the third end 524 to or proximate a fourth corner 558 at the intersection of the second end 522 to the fourth end 526. In some embodiments, the first direction is perpendicular to the second direction. In some embodiments, the first direction is oblique relative to the second direction.

In some embodiments, at least one of the second plurality of stripes 546 overlays at least some of the first plurality of stripes 540. In some embodiments, at least one of the second plurality of stripes 546 overlays all of the first plurality of stripes 540. In some embodiments, more than one of the second plurality of stripes 546 overlays at least some of the first plurality of stripes 540. In some embodiments, more than one of the second plurality of stripes 546 overlays all of the first plurality of stripes 540. In some embodiments, each of the second plurality of stripes 546 overlays at least some of the first plurality of stripes 540. In some embodiments, each of the second plurality of stripes 546 overlays each of the first plurality of stripes 540.

In some embodiments, at least one of the first plurality of stripes 540 overlays at least some of the second plurality of stripes 546. In some embodiments, at least one of the first plurality of stripes 540 overlays all of the second plurality of stripes 546. In some embodiments, more than one of the first plurality of stripes 540 overlays at least some of the second plurality of stripes 546. In some embodiments, more than one of the first plurality of stripes 540 overlays all of the second plurality of stripes 546. In some embodiments, each of the first plurality of stripes 540 overlays at least some of the second plurality of stripes 546. In some embodiments, each of the first plurality of stripes 540 overlays each of the second plurality of stripes 546.

In some embodiments, the first plurality of stripes 540 and the second plurality of stripes crisscross one another. In some embodiments, each of the first plurality of stripes 540 is spaced apart from one another. In some embodiments, each of the second plurality of stripes 546 is spaced apart from one another. In some embodiments, the first plurality of stripes 540 and the second plurality of stripes 546 form a grid pattern.

In some embodiments, the first adhesive layer 508 is on substantially the entirety of the first surface 507 of the membrane layer 506. In some embodiments, the first adhesive layer 508 is on a majority of the first surface 507 of the membrane layer 506.

Variations, modifications, and alterations to embodiments of the present disclosure described above will make themselves apparent to those skilled in the art. All such variations, modifications, alterations and the like are intended to fall within the spirit and scope of the present disclosure, limited solely by the appended claims.

While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive.

Any feature or element that is positively identified in this description may also be specifically excluded as a feature or element of an embodiment of the present as defined in the claims.

The disclosure described herein may be practiced in the absence of any element or elements, limitation or limitations, which is not specifically disclosed herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

What is claimed is:

1. A building system, comprising:
an external building structure; and
a building envelope membrane installed on the external building structure, the building envelope membrane comprising:
a first release liner,
wherein the first release liner comprises:
a first polymer, and
a UV stabilizer,
wherein the first release liner includes 1 wt. % to 90 wt. % of the UV stabilizer based on a total weight of the first release liner,
wherein the first release liner includes a sufficient amount of the UV stabilizer, such that, when tested in accordance with a weathering test used to test for exposure to an external environment for 180 days, the first release liner passes the weathering test,
wherein the first release liner is an outer layer,
wherein the first release liner is removable;
a first adhesive layer;
a membrane layer,
wherein the first adhesive layer is positioned between the first release liner and the membrane layer; and
a second adhesive layer,
wherein the membrane layer is positioned between the first adhesive layer and the second adhesive layer,
wherein the second adhesive layer contacts the external building structure.

2. The building system of claim 1, wherein the first release liner further comprises at least one of an antioxidant, a process stabilizer, a thermal stabilizer, or a UV absorber.

3. The building system of claim 1, wherein the first polymer comprises polyethylene.

4. The building system of claim 1, wherein the membrane layer comprises a vapor retarder membrane layer.

5. The building system of claim 1, wherein the membrane layer comprises a multi-layer membrane layer.

6. The building system of claim 1, wherein the membrane layer comprises:
a first membrane layer,
a second membrane layer, and
a third membrane layer,
wherein the second membrane layer is between the first membrane layer and the third membrane layer,
wherein at least one of the first membrane layer or the third membrane layer comprises a polymer layer.

7. The building system of claim 6, wherein the second membrane layer comprises at least one of a solid polymer layer or a woven polymer layer.

8. The building system of claim 1, wherein at least one of the first adhesive layer or the second adhesive layer comprises a butyl adhesive.

9. The building system of claim 1, wherein the external building structure is a roof deck or an external wall.

10. The building system of claim 1, wherein the second adhesive layer includes a plurality of adhesive stripes.

11. The building system of claim 10, wherein the membrane layer includes a first end and a second end opposite the first end, wherein each of the plurality of adhesive stripes includes a first end located proximate to the first end of the membrane layer and a second end opposite the first end of the adhesive stripe and located proximate to the second end of the membrane layer.

12. The building system of claim 11, wherein at least one channel is located between a corresponding pair of adjacent ones of the plurality of adhesive stripes.

13. The building system of claim 10, wherein the plurality of adhesive stripes includes a first plurality of stripes and a second plurality of stripes, wherein each of the first plurality of stripes extends in a first direction, wherein each of the second plurality of stripes extends in a second direction, and wherein the second direction is different than the first direction.

14. A method of installation, comprising:

obtaining a building envelope membrane, the building envelope membrane comprising:

a first release liner, wherein the first release liner comprises:

a first polymer, and a UV stabilizer, wherein the first release liner includes 1 wt. % to 90 wt. % of the UV stabilizer based on a total weight of the first release liner, wherein the first release liner includes a sufficient amount of the UV stabilizer, such that, when tested in accordance with a weathering test used to test for exposure to an external environment for 180 days, the first release liner passes the weathering test, wherein the first release liner is removable;

a first adhesive layer;

a membrane layer, wherein the first adhesive layer is positioned between the first release liner and the membrane layer;

a second adhesive layer, wherein the membrane layer is positioned between the first adhesive layer and the second adhesive layer; and a second release liner, wherein the second release liner is removable to expose the second adhesive layer;

removing the second release liner, thereby exposing the second adhesive layer; and adhering the building envelope membrane to an external building structure with an exposed portion of the second adhesive layer.

15. The method of installation of claim 14, wherein after the adhering the building envelope membrane to the external building structure, removing the first release liner after a specified time, thereby exposing the first adhesive layer; and positioning a building component on an exposed portion of the first adhesive layer, and the exposed portion of the first adhesive layer adheres the building component to the building envelope membrane.

16. The method of installation of claim 15, wherein the building component includes at least one of a photovoltaic (PV) panel, a modified bitumen (MODBIT) substrate, a roofing shingle, an oriented strand board (OSB), a roll good, a board, a foam board, a polyisocyanurate (ISO) foam board, a coverboard, a fiberglass insulation board, a fire retardant board, a hail resistant board, a high density cover board, a cement board, or any combination thereof.

17. The method of installation of claim 14, wherein the first release liner includes a sufficient amount of a UV stabilizer, such that, when tested in accordance with a weathering test used to test for exposure for 180 days, the first release liner passes the weathering test.

18. The method of installation of claim 14, wherein the membrane layer comprises a vapor retarder membrane layer.

19. The method of installation of claim 14, wherein the membrane layer comprises a multi-layer membrane layer.

20. The method of installation of claim 14, wherein the external building structure is a roof deck or an external wall.

* * * * *